United States Patent [19]

Choe

[11] 4,299,242

[45] Nov. 10, 1981

[54] METHOD OF MAKING ARTIFICIAL EYELASHES

[76] Inventor: Sunjeen Choe, 2938 S. Oakhurst Ave., Los Angeles, Calif. 90034

[21] Appl. No.: 113,763

[22] Filed: Jan. 21, 1980

Related U.S. Application Data

[63] Continuation of Ser. No. 901,697, May 1, 1978, abandoned.

[51] Int. Cl.[3] ..... A41G 3/00

[52] U.S. Cl. ..... 132/53

[58] Field of Search ..... 132/53, 5; 3/1, 13

[56] References Cited

U.S. PATENT DOCUMENTS

| | | | |
|---|---|---|---|
| 2,812,768 | 11/1957 | Giuliano | 132/5 |
| 3,032,042 | 5/1962 | Meehan | 132/5 |
| 3,295,534 | 1/1967 | Dorkin | 132/5 |
| 3,833,007 | 9/1974 | Jacobs | 132/53 |

*Primary Examiner*—G. E. McNeill

*Attorney, Agent, or Firm*—Christie, Parker & Hale

[57] ABSTRACT

A method of making artificial strip and cluster eyelashes. The method includes the steps of knotting eyelash strands to a support. While still being supported, the strands are heated and bonded together along a line parallel to and adjacent the knots. After heating and bonding, the lash strands are severed from the knots along a line intermediate the knots and the heating and bonding line.

13 Claims, 6 Drawing Figures

STRIP LASH

METHOD OF MAKING ARTIFICIAL EYELASHES

CROSS REFERENCE TO RELATED APPLICATIONS

This is a continuation of application Ser. No. 901,697, filed May 1, 1978, now abandoned.

BACKGROUND OF THE INVENTION

This invention relates to artificial eyelashes and, in particular, to an improved method of making strip lashes and cluster lashes.

As a cosmetic device, artificial eyelashes are well-known and have been used for a number of years. A number of different approaches have been utilized in the making of artificial eyelashes as is illustrated by U.S. Pat. Nos. 1,450,259; 1,897,747; 2,079,256 2,421,432; 2,812,768; and British Pat. No. 459,930. In general, the eyelashes produced according to the methods disclosed in the foregoing are characterized by a support member at the fixed end of the eyelashes for securing the fixed end of the eyelashes in place. This support member or element adds a significant degree of heaviness to the feel of the lashes as they are worn and can be a source of discomfort.

In recent years, the preferred method for manufacturing artificial eyelashes has been to tie one or more human hairs or strands of synthetic eyelash material onto a string or thread support to produce a cluster or strip of lashes. This method of manufacture is customarily referred to as "knotting" and is clearly illustrated in U.S. Pat. No. 3,032,042. After the hairs or strands have been knotted together forming a long strip, the string support is cut to a desired width corresponding to the width of the human eyelid. The strip lash is then curled, cut and trimmed to specific cosmetic and design requirements and what results is what is referred to as a strip lash.

Recently, rather than providing lashes in the form of strips, it has become fashionable to provide lashes in clusters and to utilize such clusters by strategically placing them on the eyelashes of the wearer to supplement the eyelashes, thus avoiding both the weight of utilizing an entire strip of lashes and, at the same time, only supplementing the lashes where needed to enhance the naturalness of the look obtained. In the case of the manufacture or production of clusters of eyelashes, after the hairs are knotted, trimmed, curled and cut to desired length and shape, the knotted hairs are pulled off the string or thread with the result that the number of hairs or fibers knotted together at one end remain together as a cluster. These clusters of lashes are generally referred to as individual lashes or cluster lashes. When the hairs or strands of the lashes are spread at the opposite end from the knot, the resulting lashes are generally called flared lashes or flared individual lashes.

Even in the knotted lashes embodiments, according to the method of U.S. Pat. No. 3,032,042, a feeling of heaviness and bulkiness is experienced by the user due to the weight and size of the knots. In addition, the physical size of the knot, even when it is made as small as possible, has the effect of creating an unnecessary line on the wearer's lashes when they are applied, tending to disclose the fact that the wearer is using artificial eyelashes.

SUMMARY OF THE PRESENT INVENTION

The present invention solves the problem posed by the prior art by eliminating the knots which are chracteristic of the current most frequently encountered types of lashes. The invention solves this problem by providing a method of making artificial eyelashes comprising the steps of tying at least one strand of eyelash material to a string support with the strand being tied to the support at a point intermediate its ends so as to provide at least two simulated lashes extending away from the support. The lashes and string support are placed against a support surface to provide a temporary backing on one side of the support and eyelash material. The lashes are then physically secured together at an intermediate point between the tie point and the free ends of the strand by pressing the lashes into contact with the support surface with a heating and bonding implement applied to the side of the eyelash material opposite the support surface, said intermediate point corresponding to the desired artificial eyelash length. Finally, the eyelashes are separated from the tie point on the string support along a line between the tie point and the intermediate point of securing of the lashes to produce at least one pair of lashes secured together at one end and free at the opposite end.

When the lashes according to the present invention are prepared in a strip with a plurality of strands knotted on a support and bunched closely together, the result is a strip lash in which the knotted end of the lashes has been completely eliminated. Likewise, when the method of the present invention is utilized to tie a single strand or a limited number of strands in separate and discrete bunches, the result is a cluster lash, likewise, characterized by the complete absence of the knot heretofore required. The result is a lash which is significantly more appealing, both in terms of its wearability and its cosmetic effect. When such lashes are properly applied, it is extremely difficult to detect that the wearer is using supplementary lashes.

DESCRIPTION OF THE DRAWINGS

These and other aspects of the present invention will be better understood by reference to the figures of the drawing wherein.

DESCRIPTION OF A SPECIFIC EMBODIMENT

Figure 2:
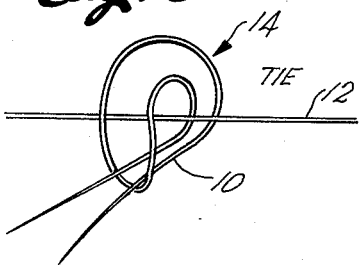
FIG. 2 is an enlarged perspective view of the type of knot utilized in attaching a strand of eyelash material to a base or support strand.
Figure 1:
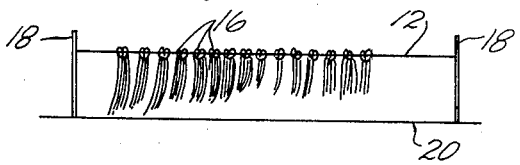
FIG. 1 is a front elevational view of the strip of artificial eyelashes mounted on a support during the manufacturing process.
Figure 3:
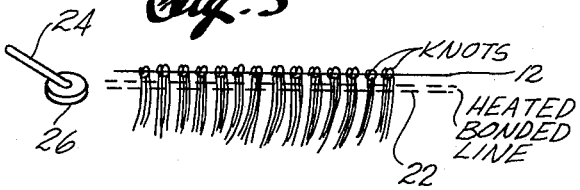
FIG. 3 is an elevational view of the heating and bonding step of the method of manufacturing lashes according to the present invention.
Figure 4:
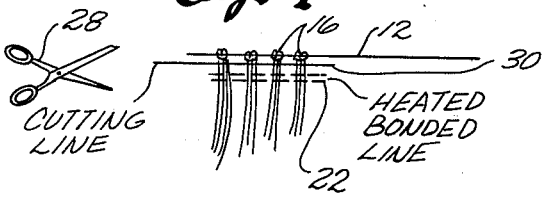
FIG. 4 is an enlarged fragmentary view of the cutting step of the present invention.
Figure 6:
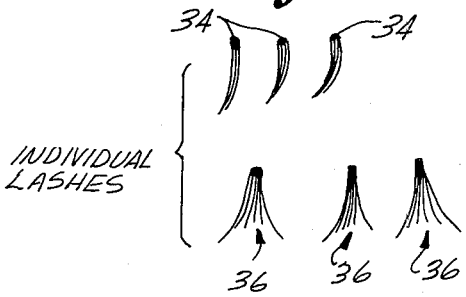
FIG. 6 illustrates cluster lashes and flared cluster lashes produced according to the present invention.

The first step in the method of making artificial eyelashes according to the present invention is to utilize strands of human hair or synthetic eyelash material 10 and to tie individual strand or groups of strands to a support thread or string 12 by such mean as a slip knot as is shown in FIGS. 1 and 2. The slip knot is shown generally at 14 of FIG. 2 and a plurality of such knots 16 are illustrated in FIG. 1. As shown in FIG. 1, support string or thread 12 extends between a pair of vertical supports 18 which are, in turn, mounted on a base support 20. Depending on the eyelash effect desired, single strands of hair or eyelash material are knotted on support 12 in some instances and a plurality of strands of eyelash material are knotted together about support 12 to serve other applications. When strip lashes are to be produced, the strands of lash material are tied close together and with uniform spacing. When individual lashes or lash clusters are to be produced, individual or multiple strands of lash material are tied together in discrete groupings with significant spacing between adjacent clusters as shown in FIGS. 1, 3 and 4. The result is groupings of clusters of lashes as shown in FIG. 6.

An enlarged view of a strip of lashes is shown in FIG. 3 to illustrate the next step of the method according to the present invention. In this step, heat is applied to the lashes below the knot to cause the strands of eyelash material to fuse together. In the presently preferred embodiment, at the same time that heat is applied to the artificial lashes, an adhesive or bonding agent is also applied in the same area to further secure the individual lashes to each other and to the lashes in adjacent knotted groups. The track or line of the application of heat and bonding is illustrated by the dashed lines at 22 in FIG. 3. Heat is applied by a rod 24 having a heated roller 26 rotatably mounted at one end thereof. It has been found that a temperature of approximately 65° C. is sufficient to obtain the fusing action desired. By laying support 12 on a flat surface with the lashes extending away from the support, roller 26 can be guided across the lashes along line 22 to obtain the application of heat to the lashes. In the preferred embodiment, roller 26 is designed so as to dispense and uniformly spread a bonding agent such as a mixture of xylen, lyka 132 and desmord-rf, across the lashes along line 22 to securely fuse and bond the lashes together.

After the bonding step, the lashes are separated from the knots by the next step of the invention. As shown therein, a cutting instrument, such as a scissors 28 is utilized along line 30 located between the heated and bonded line 22 and the support string 12. The result is a strip of lashes or clusters of lashes which are totally separated from the knot 16, thus providing a strip or cluster of lashes ending in a thin, fine line at the fixed end defined by the ends of the lashes at the heated and bonded end 22, totally eliminating the enlargement previously characteristic of lashes due to the knots of the prior art.

Figure 5:
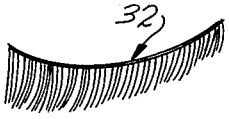
FIG. 5 is an illustration of a strip lash produced according to the present invention.

To complete the manufacturing of the artificial lashes, a strip of lashes, such as shown at 32 in FIG. 5, is cut, trimmed, and curled to the desired length and fashion depending on the intended application. Likewise, the strip 32 of lashes can be separated into clusters, such as clusters 34 as shown in FIG. 6.

As indicated above, clusters of lashes according to the present invention can be produced by tying one or a plurality of strands in groups or clusters. Following the heating and bonding steps, the result is small groupings 34 of lashes which can be placed by the wearer at the desired location with respect to the natural eyelashes of the wearer to obtain the most desirable effect. As is shown in FIG. 6, the clusters of lashes can have their free ends spread as at 36 to create flared lashes.

An alternate method of manufacture of lashes according to the present invention involves the application of heat and a bonding agent in separate steps. In this method, an oval-shaped iron rod is heated to a temperature in the range of 60° to 75° C. The heated rod is then applied to a strip of lashes or one or more clusters of lashes along a line spaced a short distance from the knots attaching the lashes to the support. The rod is held in position for approximately three to five minutes to raise the lashes to a temperature of approximately 65° C. until the fibers or strands soften and fuse.

The rod is then removed and a bonding agent is applied along the same line defined by the placement of the heated rod. The bonding agent is prepared by mixing 1000 cc xylen, 100 grams lyka 132 and 10 cc of desmord-rf. The resultant mixture is applied by means of a fine-pointed brush. The brush is drawn along the heating line to deposit a line of the bonding agent.

The heated rod is again laid on the heating line to which the bonding agent has been applied to aid in the penetration of the bonding agent into the lashes and the further heating of the strands of lashes to complete the process of securing the lashes together. The heated rod is held in position for approximately three minutes and is then removed to allow the bonding agent to dry. The entire process including the final drying step entails approximately twenty minutes.

What is claimed is:

1. A method of fabricating artificial eyelashes comprising the steps of (a) tying at least one strand of eyelash material to a string support, the strand being tied to the support at a point intermediate its ends so as to provide at least two simulated lashes extending away from the support;

(b) placing the lashes and string support against a support surface to provide a temporary backing on one side of the support and eyelash material;

(c) physically securing the lashes together at an intermediate point between the tie point and the free ends of the strand by pressing the lashes into contact with the support surface with a heating and bonding implement applied to the side of the eyelash material opposite the support surface, the intermediate point corresonding to a desired artificial eyelash length; and (d) separating the eyelashes from the tie point on the string support along a line between the tie point and the intermediate point of securing of the lashes to produce at least one pair of lashes secured together at one end and free at the opposite end.

2. The method according to claim 1 wherein the step of securing the lashes together includes the steps of supplying a bonding agent to the heating and bonding implement and thereafter applying said implement to the lashes to spread the bonding agent thereon and bond the lashes together.

3. The method according to claim 1 wherein the step of securing the lashes together includes the steps of supplying heat to the heating and bonding implement and thereafter applying said implement to the lashes to cause the lashes to be fused together.

4. The method according to claim 1 wherein the step of securing the lashes together includes the steps of supplying heat and a bonding agent to the heating and bonding implement and thereafter applying said implement to the lashes to apply heat and a bonding agent to the lashes to cause the lashes to be fused and bonded together.

5. The method according to claim 4 wherein the step of separating the lashes includes the step of cutting the lashes intermediate the point of tying to the support and the point at which heating and the bonding agent are applied.

6. A method of making artificial eyelashes comprising the steps of (a) tying a plurality of strands of eyelash material to a string support to provide a plurality of lashes;

(b) placing the lashes against a support surface to provide a temporary backing on one side of the support and eyelash material;

(c) physically securing at least two of the strands of eyelash material together at a point intermediate the tie point and the free ends of the lashes by pressing the eyelash material into contact with the support surface with a heating and bonding implement applied to the side of the strands of eyelash material opposite the support surface, the intermediate point corresponding to a desired artificial eyelash length; and (d) separating the secured together strands of eyelash material from the string support along a line intermediate the point of tying the eyelash material to the string support and the point of securing to provide at least one pair of artificial eyelashes.

7. The method according to claim 6 including the step of securing a plurality of lashes together to provide a strip of lashes.

8. The method according to claim 6 wherein the step of securing the lashes together includes the step of applying heat and a bonding agent to the lashes only a line spaced from the free ends of the lashes.

9. The method according to claim 6 wherein the step of tying a plurality of strands to a support includes the step of tying said strands in a plurality of clusters.

10. The method according to claim 7 including the step of separating the strip of lashes into a plurality of clusters of lashes.

11. The method according to claim 10 including the step of spreading the free ends of the lash cluster to provide a flared lash cluster.

12. The method according to claim 8 wherein the step of separating the lashes from the support include the step of cutting the lashes along a line adjacent the point of tying to the support.

13. The method according to claim 9 wherein the step of securing the lashes together includes the step of securing the lashes in each cluster together.

* * * * *

UNITED STATES PATENT AND TRADEMARK OFFICE

CERTIFICATE OF CORRECTION

PATENT NO. : 4,299,242

DATED : November 10, 1981

INVENTOR(S) : Sunjeen Choe

It is certified that error appears in the above—identified patent and that said Letters Patent is hereby corrected as shown below:

Column 6, line 8,"only" should read -- along --.

Signed and Sealed this

*Sixth* Day of *July 1982*

[SEAL]

*Attest:*

GERALD J. MOSSINGHOFF

*Attesting Officer*

*Commissioner of Patents and Trademarks*